US006820589B2

(12) United States Patent
Okubo et al.

(10) Patent No.: US 6,820,589 B2
(45) Date of Patent: Nov. 23, 2004

(54) IDLE SPEED CONTROL METHOD AND SYSTEM

(75) Inventors: Carol Louise Okubo, Belleville, MI (US); John Ottavio Michelini, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 15 days.

(21) Appl. No.: 10/273,206

(22) Filed: Oct. 17, 2002

(65) Prior Publication Data

US 2004/0074473 A1 Apr. 22, 2004

(51) Int. Cl.[7] ..... F02D 41/00

(52) U.S. Cl. ..... 123/339.19; 123/339.1; 123/339.14; 123/339.21

(58) Field of Search ..... 123/339.23, 339.19, 123/339.1, 339.14, 339.21

(56) References Cited

U.S. PATENT DOCUMENTS 4,509,477 A * 4/1985 Takao et al. ..... 123/339.11
5,111,788 A 5/1992 Washino
5,249,558 A 10/1993 Imamura
5,421,302 A * 6/1995 Livshits et al. ..... 123/339.23
5,590,630 A 1/1997 Kurihara et al.
5,651,341 A 7/1997 Harada et al.
5,662,084 A 9/1997 Deguchi et al.
5,740,045 A * 4/1998 Livshiz et al. ..... 701/101
6,202,629 B1 3/2001 Zhu et al.
6,305,350 B1 10/2001 Livshiz et al.

FOREIGN PATENT DOCUMENTS

EP 1072778 1/2001

* cited by examiner

*Primary Examiner*—Bibhu Mohanty

(57) ABSTRACT

A method and system for generating an idle control signal for an internal combustion engine is disclosed. Rotational speed, n, of the engine is measured. Combustion generated torque $\tau_{ind}$ is estimated as a function of the measured engine rotational speed, n. The idle control signal for the engine is produced as a function of the difference between: (A) a time rate of change in such measured engine rotational speed, dn/dt, and; (B) the sum of the estimated combustion generated torque $\tau_{ind}$ and a function of an engine idle speed error. The idle speed error is representative of the difference between an idle speed set point and the measured rotational speed, n. Thus, idle speed control is achieved using only a feedback system which responds to measured operating conditions of the engine rather than with a combination of feedback and a feedforward model which relies on a model of each individual engine loss or load to calculate the resulting impact on the engine.

7 Claims, 3 Drawing Sheets

IDLE SPEED CONTROL METHOD AND SYSTEM

TECHNICAL FIELD

This invention relates to internal combustion engine idle speed control methods systems and more particularly to methods and systems for estimating engine load in controlling idle speed.

BACKGROUND

As is known in the art, engine idle operation involves providing enough power output from the engine to compensate for engine friction and pumping losses, and to counteract front-end accessory and transmission loading. Too much power will cause an annoying flare in engine speed, and too little power will result in a dip in engine speed which may destabilize engine operation or even cause the engine to stall. Idle speed control strategies consist of one or a combination of:

i. feed-forward control to estimate the magnitude of the engine losses and loading based on environmental conditions (e.g., ambient temperature, engine coolant temperature, transmission state, and air-conditioning and power-steering conditions); and ii. feedback control to correct engine speed errors which result from unanticipated loads and errors in the feed-forward estimations.

The feed-forward control typically relies on a model of each individual engine loss or load to calculate the resulting impact on the engine. The inventor has recognized that these models can be quite complex and require calibration for a number of tables or parameters which describe the physics involved. Further, the inventors have recognized that this model-based approach is limited by the sensor's ability to detect the variables affecting the presence, magnitude and timing of a given load, and it is incapable of compensating for a load which is unanticipated.

SUMMARY

In accordance with the present invention, a method is provided for generating an idle control signal for an internal combustion engine. The method includes: estimating engine combustion torque; and generating the idle control signal as a function of the estimated combustion torque and engine speed, n.

In accordance of one feature of the invention, a method is provided for generating an idle control signal for an internal combustion engine. The method includes: estimating combustion torque $\tau_{ind}$; and producing the idle control signal for the engine as a function of the difference between: (A) a time rate of change in engine rotational speed, dn/dt, and; (B) the sum of the estimated combustion generated torque $\tau_{ind}$ and a function of an engine idle speed error, such idle speed error being representative of the difference between an idle speed set point and determined rotational speed, n.

In accordance of one feature of the invention, a method is provided for generating an idle control signal for an internal combustion engine. The method includes: determining rotational speed, n of the engine; estimating in-cylinder air charge; estimating combustion generated torque $\tau_{ind}$ as a function of the measured engine rotational speed, n, and the estimated cylinder air charge; and producing the idle control signal for the engine as a function of the difference between: (A) a time rate of change in such determined engine rotational speed, dn/dt, and; (B) the sum of the estimated combustion generated torque $\tau_{ind}$ and a function of an engine idle speed error, such idle speed error being representative of the difference between an idle speed set point and the determined rotational speed, n.

In accordance with another feature of the invention, a method is provided for generating an idle control signal for an internal combustion engine. The method includes: determining rotational speed, n of the engine; determining mass air flow through an intake manifold throttle of the engine; estimating cylinder air charge as a function the determined mass air flow; estimating combustion generated torque $\tau_{ind}$ as a function of the determined engine rotational speed, n, and the estimated cylinder air charge; and producing the idle control signal for the engine as a function of the difference between: (A) a time rate of change in such determined engine rotational speed, dn/dt, and; (B) the sum of the estimated combustion generated torque $\tau_{ind}$ and a function of an engine idle speed error, such idle speed error being representative of the difference between an idle speed set point and the determined rotational speed, n.

The current invention, may equivalently be performed in two steps. First, a real-time estimation of the engine losses and loading is obtained using an estimate of the current cylinder air charge (which may be estimated from measured mass airflow through the intake manifold) and a function of the change in engine speed. Then, the idle speed control is provided as the sum of the engine losses and loading, and a function of the idle speed error. It may be seen that this approach is equivalent to the previous embodiments. In this strategy, only the relationship between total, or net, engine torque and engine speed need be modeled and calibrated. Hence this value is readily available without additional sensors or calibration effort. The dependence on the change in engine speed is fundamentally related to the total inertia of the engine, and hence is not dependent on changes in environmental or driving conditions. Furthermore, this simple strategy requires no foreknowledge of the presence of a load (e.g., the air conditioner clutch engaging) and allows a reduction in the required vehicle sensor set.

The details of one or more embodiments of the invention are set forth in the accompanying drawings and the description below. Other features, objects, and advantages of the invention will be apparent from the description and drawings, and from the claims.

DESCRIPTION OF DRAWING

The invention will now be described further, by way of example, with reference to the accompanying drawings, in which.

Like reference symbols in the various drawings indicate like elements.

DETAILED DESCRIPTION

Figure 1A:
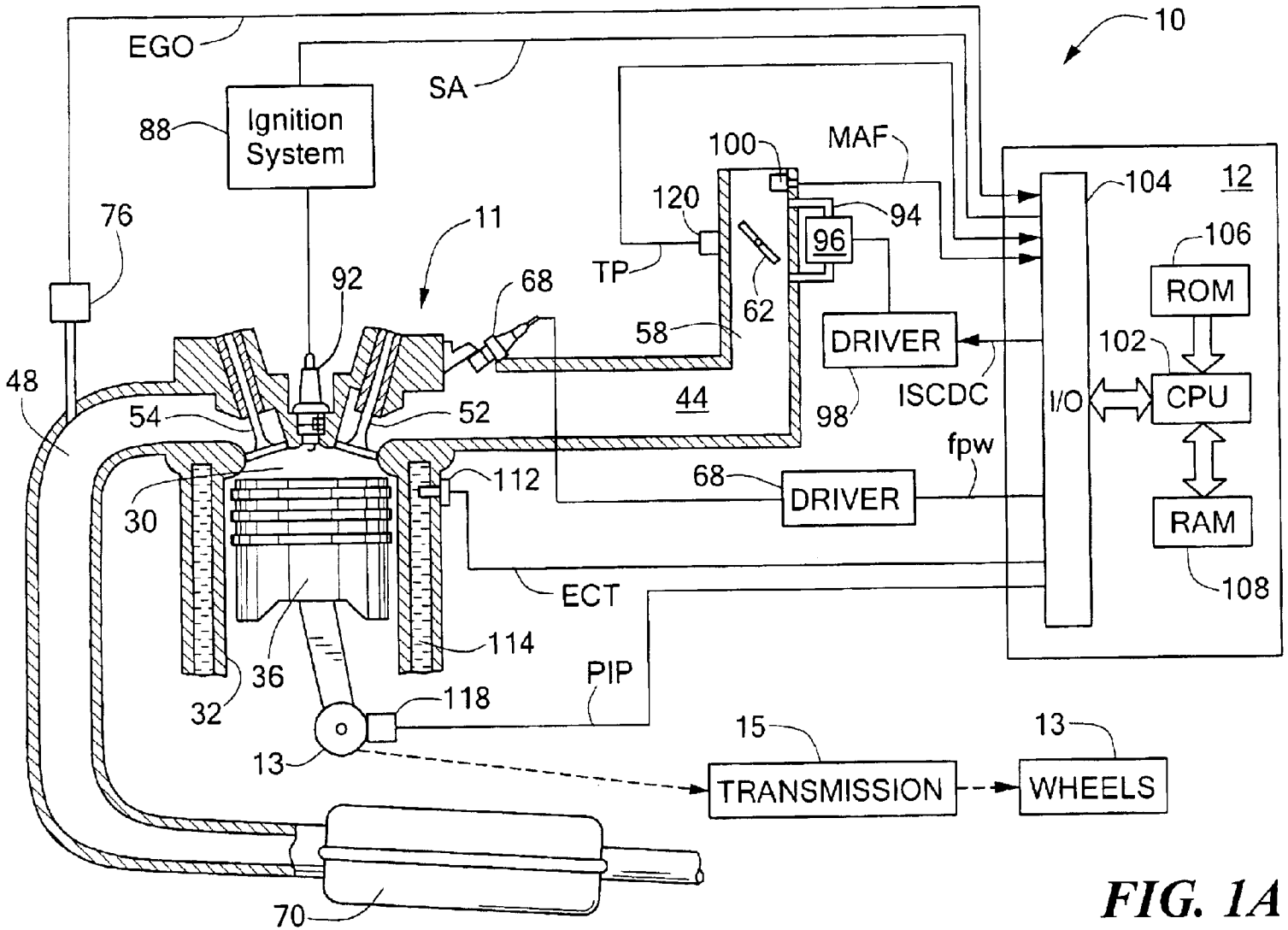
FIG. 1A is diagram of an internal combustion engine system having an idle control system according to the invention.

Referring now to FIG. 1, an internal combustion engine system 10. The engine system includes an engine 11 comprising a plurality of cylinders, one cylinder of which is shown. The engine 11 is controlled by electronic engine controller 12. Engine 11 includes combustion chamber 30 and cylinder walls 32 with piston 36 positioned therein and connected to crankshaft 40. Combustion chamber 30 is shown communicating with intake manifold 44 and exhaust manifold 48 via respective intake valve 52 and exhaust valve 54. Intake manifold 44 is shown communicating with throttle body 58 via throttle plate 62. In this particular embodiment, throttle plate 62 is coupled to an operator actuated accelerator pedal (not shown) via a conventional throttle cable (not shown). The crankshaft is mechanically coupled to wheels 13 of the vehicle, not shown, carrying the engine system 10 through a transmission 15, as shown, in any conventional manner.

Intake manifold 44 is also shown having fuel injector 66 coupled thereto for delivering liquid fuel in proportion to the fuel pulse width (fpw) signal received from controller 12 via conventional electronic driver 68. Fuel is delivered to fuel injector 66 by a conventional fuel system (not shown) including a fuel tank, fuel pump, and fuel rail.

Exhaust gas oxygen sensor 76 is shown coupled to exhaust manifold 48 upstream of catalytic converter 70. In this particular example, sensor 76 provides signal EGO to controller 12 which converts signal EGO into two-state signal EGOS. A high voltage state of signal EGOS indicates exhaust gases are rich of a desired air/fuel ratio and a low voltage state of signal EGOS indicates exhaust gases are lean of the desired air/fuel ratio. Typically, the desired air/fuel ratio is controlled to stoichiometry +/−1% which causes catalytic converter 70 to operate at peak efficiency.

In the particular embodiment shown in FIG. 1, idle bypass passageway 94 is shown coupled to throttle body 58 in parallel with throttle plate 62 to provide air to intake manifold 44 via bypass throttling device 96 independently of the position of throttle plate 62. In this particular example, bypass-throttling device 96 is a conventional electronically actuated solenoid valve. Controller 12 provides pulse width modulated signal ISCDTY to the solenoid valve via electronic driver 98 so that airflow is inducted through bypass passageway 94 at a rate proportional to the duty cycle of signal ISCDTY.

Conventional distributorless ignition system 88 provides ignition spark to combustion chamber 30 via spark plug 92 in response to spark advance signal SA from controller 12.

Controller 12 is shown in FIG. 1 as a conventional microcomputer including: microprocessor unit 102, input/output ports 104, an electronic storage medium for storing executable programs and calibration values shown as memory chip 106 in this particular example, random access memory 108, and a conventional data bus. Controller 12 is shown receiving various signals from sensors coupled to engine 11, in addition to those signals previously discussed, including: measurements of inducted mass air flow (MAF) from mass air flow sensor 100 which is coupled to throttle body 58 upstream of air bypass passageway 94 to provide a total measurement of airflow inducted into intake manifold 44 via both throttle body 58 and bypass passageway 94; engine coolant temperature (ECT) from temperature sensor 112 coupled to cooling sleeve 114; a profile ignition pickup signal (PIP) from Hall effect sensor 118 coupled to crankshaft 40; and throttle position TP from throttle position sensor 120. Engine speed n is measured or detected by counting signal PIP from sensor 118 in a conventional manner.

Figure 1B:
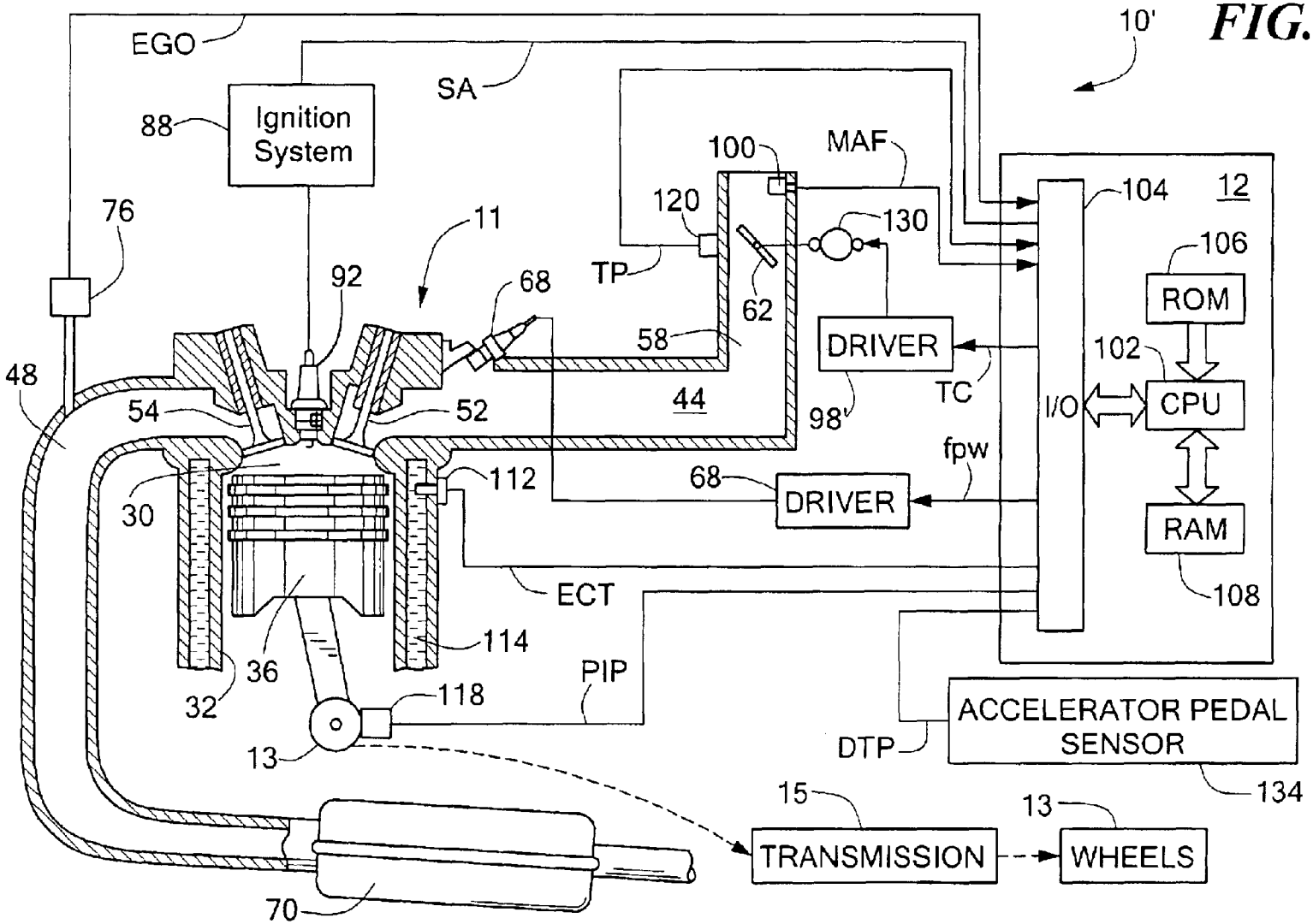
FIG. 1B is diagram of an alternative internal combustion engine system having an idle control system according to the invention.

An alternate embodiment is shown in FIG. 1B wherein like numerals refer to like parts shown in FIG. 1A. In general the differences between the two embodiments relate to the manner in which throttle plate 62 is controlled. The embodiment of FIG. 1A describes throttle plate 62 as mechanically coupled to the accelerator pedal. On the other hand, the embodiment shown in FIG. 1B describes an electronically controlled throttle plate 62'. It is noted that equivalent elements in FIG. 1B are indicated with a prime (') designation. Because throttle plate 62' is electronically controlled, an idle bypass valve (element 96 of FIG. 1A) is not provided.

Figure 2:
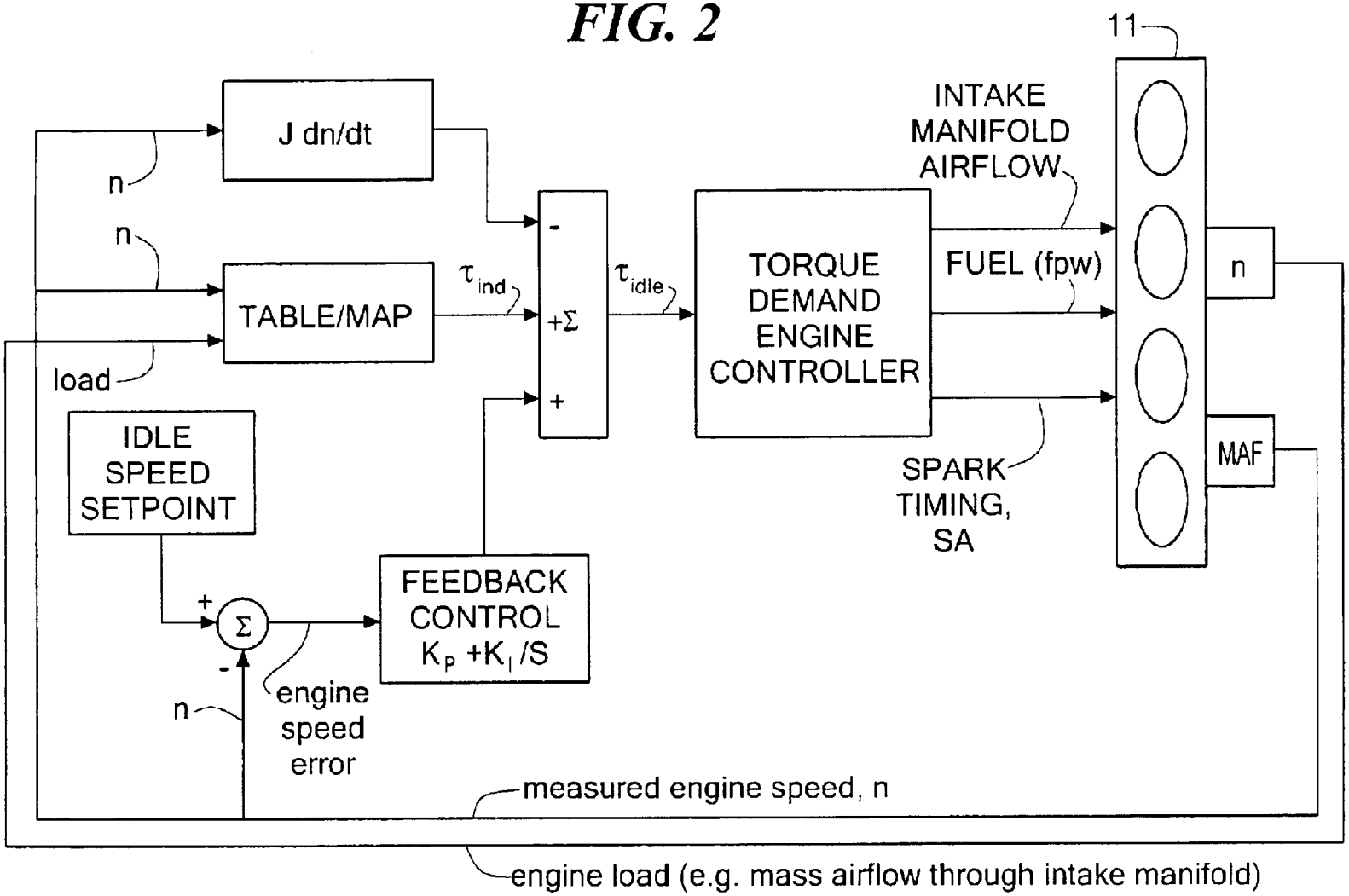
FIG. 2 is a functional block diagram of the engine control system used in the engines of FIGS. 1A and 1B according to the invention.

Referring now to FIG. 2 a block diagram is shown of the idle control system implemented by the controller executing computer code stored in ROM 106 of controller 12. The idle control system includes a feedback loop wherein the difference between an idle speed setpoint and measured engine speed, n, provides an engine speed idle signal. The engine speed error is processed by a conventional proportional plus integral control function. The output of the proportion plus integral control function is added to indicated torque $\tau_{ind}$ and subtracted from the product of the engine 11 effective rotational inertia, J, and the time rate of change in engine speed, dn/dt, to produce a torque based idle speed control signal, $\tau_{idle}$. The torque based idle speed control signal $\tau_{idle}$ is fed to a conventional torque based controller to produce the requisite airflow through the intake manifold 44 via driver 98 in FIG. 1A or driver 98' in FIG. 1B, the desired fuel quantity, fpw, for the fuel injector, and proper spark plug fire timing signal, i.e., the spark advance signal SA, for the engine 11.

More particularly, as noted above, here the engine idle control is a torque based control system, it being understood that the control system may be based on other parameters, such as a power based idle control system. Thus, here a torque based controller responds to a torque based idle control signal, $\tau_{idle}$, to adjust engine spark timing, fuel, and airflow through the engine 11 intake manifold, or in the case of a DISI engine, fuel is provided directly into the cylinders of the engine 11. As will be described in more detail below, the method for generating the idle control signal, $\tau_{idle}$, includes: estimating load torque on the engine 11; and generating the idle control signal, $\tau_{idle}$, as a function of the estimated combustion torque.

More particularly, the method includes estimating combustion torque $\tau_{ind}$; and producing the idle control signal, $\tau_{idle}$, as a function of the difference between: (A) a time rate of change in engine 11 rotational speed, n, and; (B) the sum of the estimated combustion generated torque $\tau_{ind}$ and a function of an engine 11 idle speed error. The idle speed error is representative of the difference between an idle speed set point and the measured rotational speed, n. Here, the estimated combustion torque, $\tau_{ind}$, is provided by a lookup or regression from measured mass airflow (MAF) through the intake manifold of the engine 11 and the measured engine 11 rotational speed, n. While measured mass airflow is used, such measurement, in effect, provides an estimate of cylinder air charge, and this cylinder air charge estimate, in effect, provides the estimated combustion torque, $\tau_{ind}$.

Incidentally, the present invention provides a real-time estimate of the magnitude of the front-end accessory (fead) and transmission loads on the engine 11 by utilizing the engine 11 speed in conjunction with engine-mapped calibration tables which provide the current engine 11 indicated torque and total friction and pumping losses. If a switch is present which indicates that a load will be applied to the engine (e.g. an air conditioner clutch is to be engaged), then a comparison between this estimated torque before and after the load is applied may be used to learn the magnitude of a given load. When such a switch is present, this learned value may be used as a feedforward term to compensate for these loads during idle speed operation to reduce engine speed dips and flares as the engine loading changes. The description of this invention will begin with the principle upon which the estimation procedure is based, and will then describe the use of such principle with a power-based idle speed control system.

Thus, the torque-based idle controller in the FIG. 2 be represented by the following:

$$\begin{aligned}\tau_{idle} &= \tau_{losses} + \tau_{loads} + \tau_{feedback}\\ &= \tau_{losses} + \left(\tau_{ind} - \tau_{losses} - J\frac{dn}{dt}\right) + \tau_{feedback}\\ &= \tau_{ind} - J\frac{dn}{dt} + \tau_{feedback}\end{aligned}$$

where:

J is the effective rotational inertia of the engine 11, the term effective referring to the fact that the inertia is more than inertia of the engine, i.e., includes transmission and accessories to which engine is coupled, n is the engine 11 rotational speed, $\tau_{ind}$, is the indicated (or combustion) torque. The indicated torque is predominantly a function of engine 11 speed and load, and may be estimated based on these-via lookup table. The term $\tau_{feedback}$, is a function of the measured engine 11 speed, n. More specifically, $\tau_{feedback}$ is the difference between the idle speed setpoint and measured engine 11 speed (i.e., engine speed error) operated upon by a proportional plus integral controller, as shown in the FIG. 2. The signal $\tau_{idle}$ is fed to a conventional torque based control system for generating spark timing, fuel (fpw) and airflow control signals for the engine 11.

Estimation of Engine Load

A first principles look at the relationship between the net torque on the crankshaft and the engine 11 rotational speed provides the following:

$$\begin{aligned}Jn &= \int \tau_{net}\\ &= \int (\tau_{ind} - \tau_{fric} - \tau_{pump} - \tau_{fead} - \tau_{trans})\\ &= \int (\tau_{ind} - \tau_{losses} - \tau_{loads})\end{aligned}$$

where J is the effective rotational inertia of the engine/transmission/accessories, n is the engine 11 rotational speed, $\tau_{ind}$ is the indicated (or combustion) torque, $\tau_{losses}=\tau_{fric}+\tau_{pump}$ is the total resistive torque resulting from mechanical friction and pumping work, and $\tau_{loads}=\tau_{fead}+\tau_{trans}$ represents the loads being applied to the engine 11 from the accessory drives and the transmission. The indicated torque is predominantly a function of engine 11 speed and load, and may be estimated based on these variables. In one method, this may include a lookup table. The mechanical friction and pumping losses are typically difficult to separate, and is calculated as a lumped torque through a regression using the variables: engine 11 speed, load, air charge temperature, engine coolant temperature, EGR rate and CMCV state. The only unknown (and not currently estimated) variable in the above relationship is the total load torque. Hence $$\tau_{loads} = \tau_{ind} - \tau_{losses} - J\frac{dn}{dt}.$$

When implemented in the strategy the differentiation of engine 11 speed becomes a differencing which requires application of one or more filtering techniques to reject extraneous noise.

In reality, $\tau_{loads}$ will also include any errors in the mapped estimation of the indicated and loss torques.

Using Torque Load Estimation for Idle Speed Control

The idle speed controller, as shown in the FIG. 3, includes of a feedback term which senses measured engine 11 speed, n, used with a model of the relationship between combustion torque $\tau_{ind}$ and measured engine rotational speed. The torque based idle control signal, $\tau_{idle}$, represents a base amount of torque required to operate the engine 11 at a given idle speed. Depending on the nature of the engine controller it is understood that these values may also be expressed equivalently as a required airflow, fuel mass, engine 11 torque or engine 11 power. In the case of a torque-based idle speed control shown in FIG. 3, this would result in $$\tau_{idle} = \tau_{ind} - J\frac{dn}{dt} + \tau_{feedback},$$

equivalently, with a power-based idle speed controller, the power based control signal, $P_{idle}$ fed to a power-based engine controller would be:

$$P_{idle} = n_{idle}\left(\tau_{ind} - J\frac{dn}{dt}\right) + P_{feedback},$$

where:

$n_{idle}$ is idle speed setpoint; and $P_{feedback}$ would be calculated using a proportional-integral control acting on the difference between the idle speed setpoint and the measure engine rotational speed.

Thus, idle speed control is achieved using only a feedback system which responds to measured operating conditions of the engine rather than with a combination of feedback and a feedforward model which relies on a model of each individual engine loss or load to calculate the resulting impact on the engine.

A number of embodiments of the invention have been described. Nevertheless, it will be understood that various modifications may be made without departing from the spirit and scope of the invention. For example, the feedback method used to determine the signal $\tau_{feedback}$ may use a control method other than proportional-integral control. Accordingly, other embodiments are within the scope of the following claims.

What is claimed is:

1. A method is provided for generating an idle control signal for an internal combustion engine, such method, comprising:

estimating engine combustion torque;

generating the idle control signal as a function of the estimated combustion torque and engine speed;

determining an engine idle speed error representative of a difference between an idle speed setpoint and said engine speed wherein said idle control signal is a function of the difference between: (A) a time rate of change in said engine speed, and, (B) the sum of the estimated combustion generated torque, $\tau_{ind}$, and a function of said engine idle speed error.

2. A method for generating an idle control signal for an internal combustion engine comprising:

determining rotational speed, n, of the engine;

estimating combustion generated torque, $\tau_{ind}$; and producing the idle control signal for the engine as a function of the difference between: (A) a time rate of change in determined engine rotational speed, dn/dt, and; (B) the sum of the estimated combustion generated torque, $\tau_{ind}$, and a function of an engine idle speed error, such idle speed error being representative of the difference between an idle speed set point and the determined rotational speed, n.

3. A method for generating an idle control signal for an internal combustion engine comprising:

determining rotational speed, n, of the engine;

estimating cylinder air charge;

estimating combustion generated torque, $\tau_{ind}$, as a function of the determined rotational speed, n, and estimated cylinder air charge; and producing the idle control signal for the engine as a function of the difference between: (A) a time rate of change in such determined engine rotational speed, dn/dt, and (B) the sum of the estimated combustion generated torque, $\tau_{ind}$, and a function of an engine idle speed error, such idle speed error being representative of the difference between an idle speed set point and the determined rotational speed, n.

4. The method recited in claim 3 wherein said estimation of cylinder air charge is based on a signal from a mass airflow sensor disposed in an air intake of the engine and said engine rotational speed.

5. The method recited in claim 3 wherein said estimation of cylinder air charge is based on said engine rotational speed and an indication of pressure in an intake manifold of the engine.

6. A method, comprising:

providing an article of manufacture having a computer storage medium with a computer program encoded therein for:

determining rotational speed, n, of the engine;

estimating combustion generated torque, $\tau_{ind}$; and producing the idle control signal for the engine as a function of the difference between: (A) a time rate of change in determined engine rotational speed, dn/dt, and; (B) the sum of the estimated combustion generated torque, $\tau_{ind}$, and a function of an engine idle speed error, such idle speed error being representative of the difference between an idle speed set point and the determined rotational speed, n.

7. The method recited in claim 6 wherein the proving comprises providing the storage medium as a chip.

* * * * *